United States Patent [19]

Weisz et al.

[11] 4,442,784

[45] Apr. 17, 1984

[54] VERTICALLY STACKED COMPONENTS IN A CONTROL MODULE FOR A SEWING MACHINE

[75] Inventors: William Weisz, Tenafly; Raymond S. Tyburcy, Middletown, both of N.J.

[73] Assignee: The Singer Company, Stamford, Conn.

[21] Appl. No.: 449,718

[22] Filed: Dec. 14, 1982

[51] Int. Cl.[3] ..... D05B 3/02

[52] U.S. Cl. ..... 112/158 C; 235/145 R

[58] Field of Search ..... 200/340; 235/123, 145 R; 112/158 C, 158 B, 158 D, 158 A, 158 R

[56] References Cited

U.S. PATENT DOCUMENTS

| | | | |
|---|---|---|---|
| 3,041,988 | 7/1962 | Fujita . | |
| 3,085,526 | 4/1963 | Kawaguchi . | |
| 3,156,205 | 11/1964 | Reeber et al. . | |
| 3,217,677 | 11/1965 | Eguchi . | |
| 3,279,402 | 10/1966 | Eguchi . | |
| 3,332,380 | 7/1967 | Yanagibayashi . | |
| 3,356,051 | 12/1967 | Eguchi . | |
| 3,834,334 | 9/1974 | Adams et al. . | |
| 3,841,246 | 10/1974 | Casner et al. . | |
| 4,297,956 | 11/1981 | Meier . | |
| 4,392,441 | 7/1983 | Eguchi | 112/158 B |

FOREIGN PATENT DOCUMENTS

| | | |
|---|---|---|
| 2839963 | 9/1978 | Fed. Rep. of Germany . |
| 2840209 | 3/1980 | Fed. Rep. of Germany . |
| 32-297356 | 4/1962 | Japan . |
| 39-588900 | 10/1964 | Japan . |
| 41-317941 | 1/1966 | Japan . |
| 50-400457 | 3/1975 | Japan . |
| 54-163151 | 12/1979 | Japan . |
| 55-30603 | 2/1980 | Japan . |
| 55-40594 | 3/1980 | Japan . |
| 56-136665 | 10/1981 | Japan . |
| 56-145479 | 11/1981 | Japan . |
| 56-145480 | 11/1981 | Japan . |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A control module for a sewing machine is provided with spaced apart plates, each to support a set of push-buttons arranged in multiple rows. The push-buttons include extensions which are contiguously stacked vertically for slidable movement and operate against aligned posts in actuated position of the push-buttons.

9 Claims, 7 Drawing Figures

VERTICALLY STACKED COMPONENTS IN A CONTROL MODULE FOR A SEWING MACHINE

DESCRIPTON

BACKGROUND OF THE INVENTION

1. Field of the Invention:

The invention relates to sewing machines with push-button controls.

2. Description of the Prior Art

It is well known to provide a sewing machine with pattern selecting push-buttons. Push-button controls may be seen, for example, in U.S. Pat. No. 4,297,956, for "Zig-zag Sewing Machine Having Base-Mounted Operating Elements for Controlling Sewing" issued Nov. 3, 1981, and in U.S. Pat. No. 3,332,380 for "Device for Free Selection of Zig-zag Pattern Discs in Sewing Machines" issued July 25, 1967.

The present invention relates to a compact push-button control arrangement of the kind which is disclosed in the copending patent application of William Weisz, for "Push-Button Control Module for a Sewing Machine", Serial No. 06/449,721, filed 12/14/82, and wherein a larger number of slidable contiguously stacked push-button extensions are present in a vertical column opposite stacked slidable cam followers that are actuable by the push-button extensions.

It is an object of the present invention, in a push-button control arrangement which includes a large number of vertically stacked slidable push-button extensions, to prevent an excessive build up of friction between the said extensions and to prevent an accumulation of manufacturing thickness variations in the stacked extensions such as would interfere with the proper operation of the control.

It is a further object of the invention, in a push-button control arrangement, to prevent an excessive build-up of friction and disadvantageous accumulation of manufacturing thickness variations in vertically stacked slidable push-button extensions and cam followers.

Other objects and advantages of the invention will become apparent during a reading of the specification taken in connection with the accompanying drawings.

SUMMARY OF THE INVENTION

A push-button control for a sewing machine including a large number of push-buttons with slidable vertically stacked contiguous push-button extensions to act against slidable cam followers in alignment with the push-button extensions is provided with fixed spaced apart plates to engage certain of the extensions and cam followers and so support the push-buttons and cam followers in discrete sets. The plates are affixed to vertical posts and are preferably of a resilient material having openings with enlarged end portions through which the plates can be threaded on the posts, and narrow portions into which the posts can be snapped by lateral movement of the plates to cause the plates to elastically grip the posts.

DESCRIPTION OF THE PREFERRED EMBODIMENT

Figure 1:
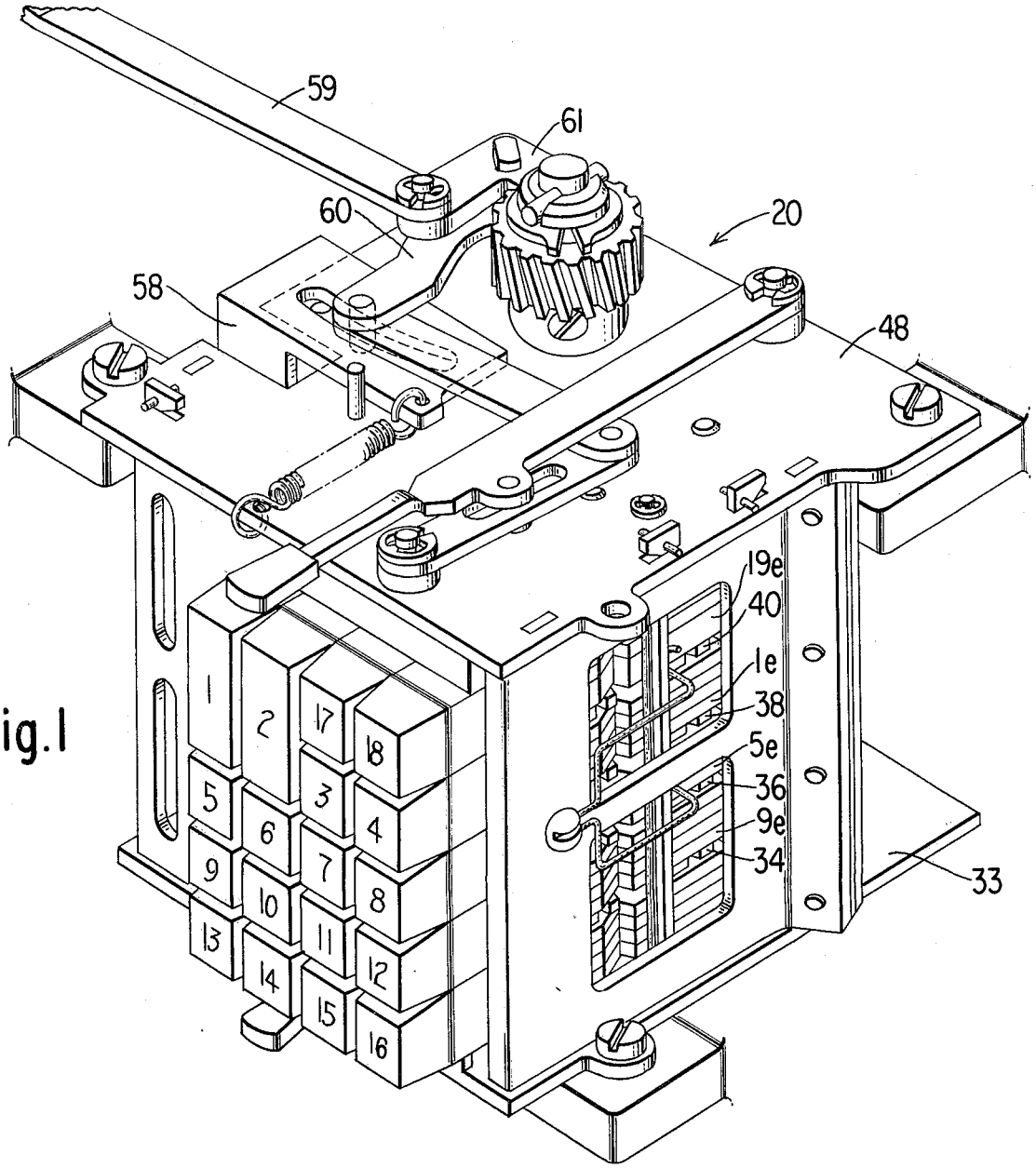
FIG. 1 is a perspective view of a sewing machine control module embodying the construction of the present invention.
Figure 3:
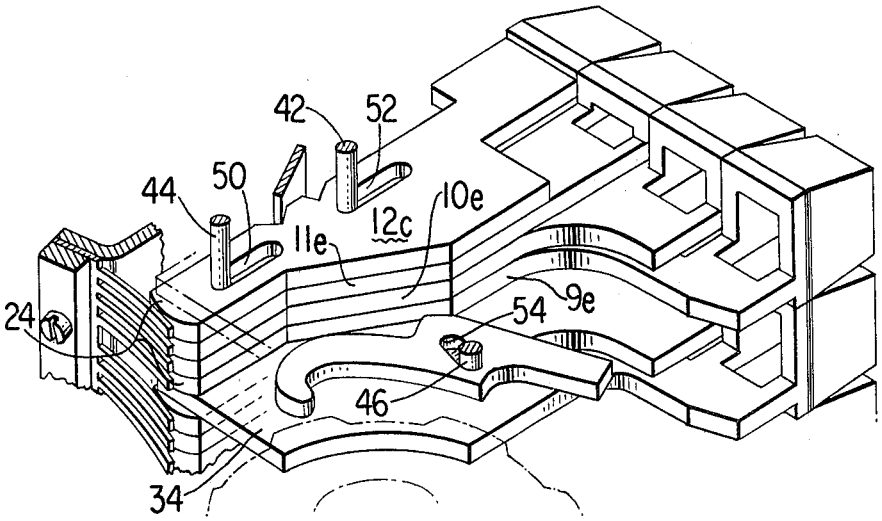
FIG. 3 is a perspective view showing a typical set of push-buttons on a supporting plate.
Figure 2:
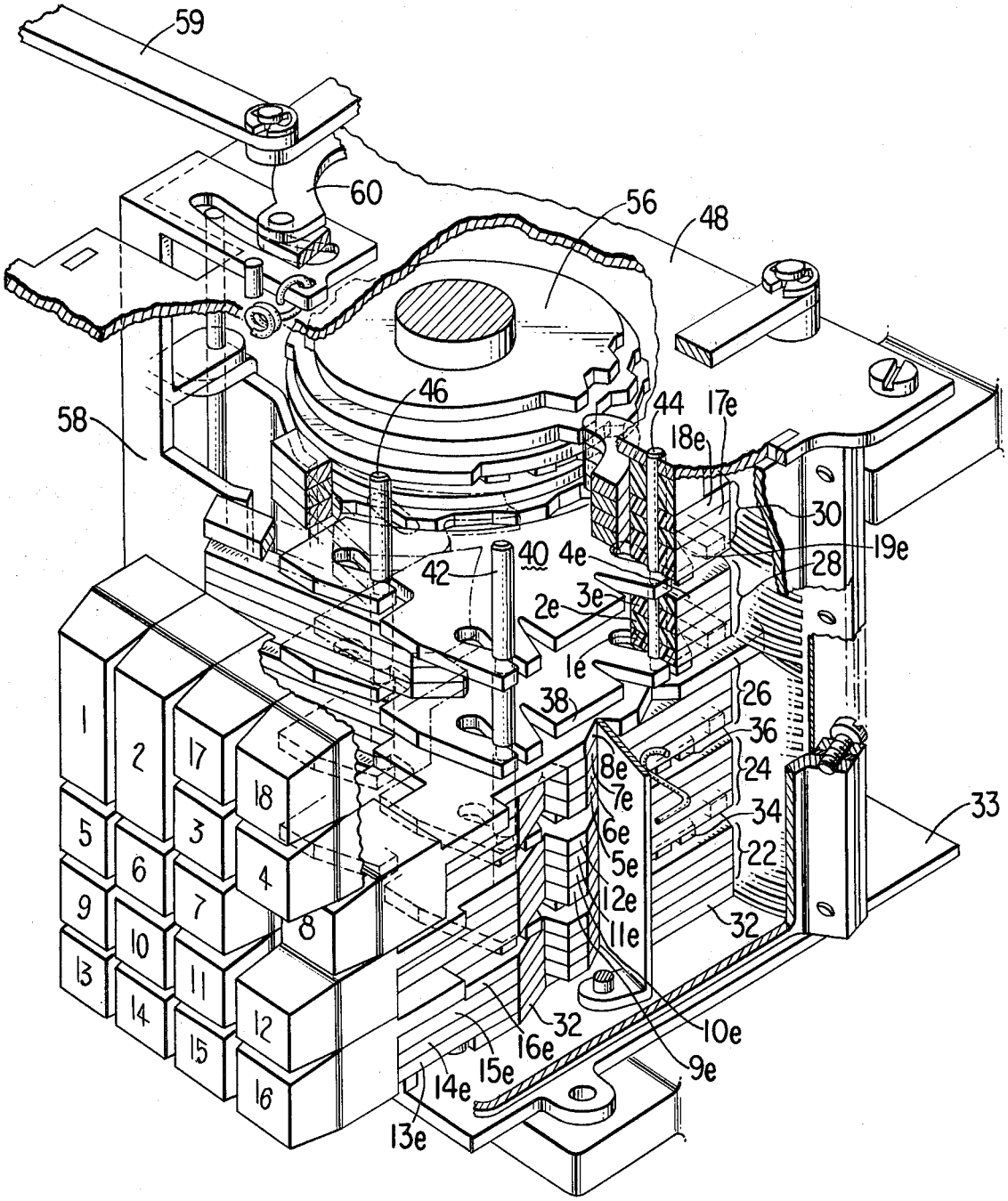
FIG. 2 is an enlarged perspective view of the control module with portions broken away to show internal parts.
Figure 4:
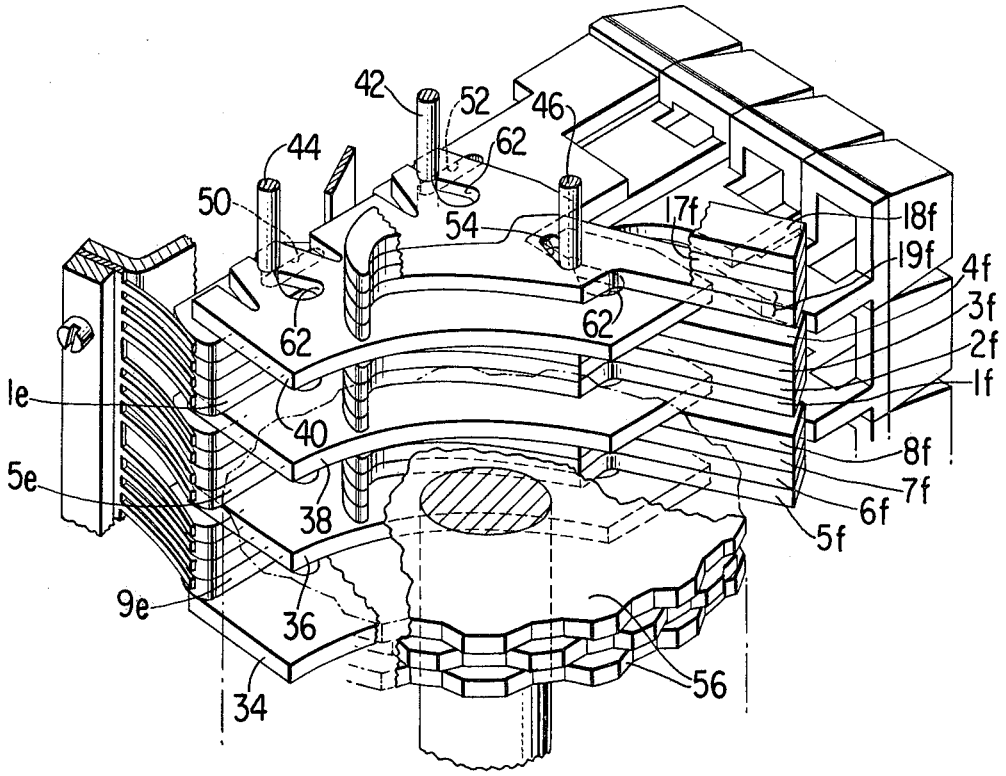
FIG. 4 is a perspective view showing several sets of push-buttons and cam followers on set dividing plates.
Figure 5:
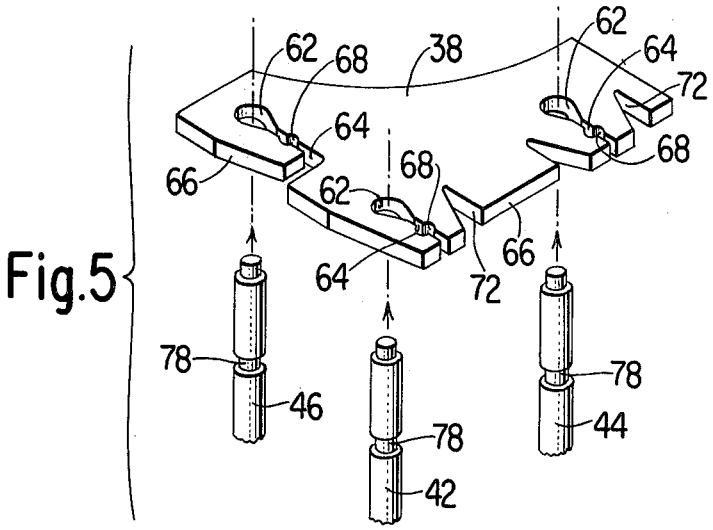
FIGS. 5, 6 and 7 are perspective views showing how set dividing plates are affixed to upright posts in the control module.
Figure 6:
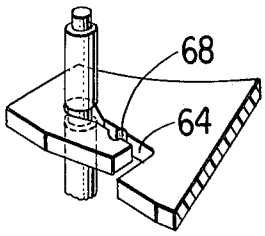
Figure 7:
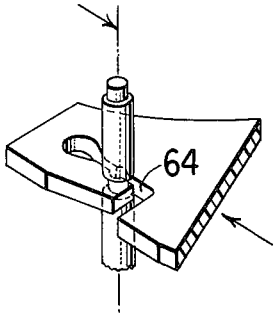

Referring to the drawings, reference character 20 designates a sewing machine push-button control module of the king disclosed in U.S. Patent Application Ser. No. 06/449,721, mentioned hereinbefore. As shown, the module includes mulitiple rows of push-buttons numbered 1 through 16, and additional push-buttons 17 and 18. Each of push-buttons 1 through 18 is formed with a rearward extension which is identified by a reference character that is the same as the principle reference character, but has a subscript e added thereto. Reference character 19*e* denotes a floating push-button extension associated with each of push-buttons 17 and 18 in the manner described in the aforementioned patent application. The extensions are all vertically stacked and slidable on one another.

The push-button extensions and push-buttons are supported in accordance with the invention in sets 22, 24, 26, 28 and 30. Set 22 is the lower most set and it is supported in the module on a member 32 engaged by extension 13*e*. The other sets are supported on set dividing plates 34, 36, 38 and 40 in engagement with extensions 9*e*, 5*e*, 1*e* and 19*e*, respectively. Plates 34, 36, 38 and 40 are affixed in the module on cylindrical posts 42, 44 and 46 extending between and secured in the bottom plate 33 and top plate 48 of the module. Each of the push-button extensions includes elongate slots 50 and 52, and the posts 42 and 44 extend through these slots to guide sliding movement of the push-button extensions. Post 46 extends through slots 54 in slidable cam followers and serves to guide sliding movement thereof in the module. The followers are aligned with and are actuable by the push-button extensions. Such followers are designated by the same numbers as the actuating push-button extensions, but have a subscript f added thereto in place of the e used in association with the numbers identifying the extensions. The cam followers are operable by rotatable cams 56 (of which there is one for each follower); a pivoted wobble plate 58 is operable by the cam followers; and a needle bight controllong member 59 is operable by the wobble plate acting through link 60 and bell crank 61 all in the manner described in the aforementioned patent application.

Plates 34, 36, 38 and 40 are preferably of a resilient plastic material. Each of the plates is formed with through openings which include an enlarged end portion 62 and a narrower portion 64 extending to the edge 66 of the plate. When the module 20 is assembled, the posts 42, 44 and 46 are threaded through the enlarged portions 62 of the plate openings, posts 42 and 44 are passed through the slots 52 and 50 respectively in the push-button extensions, and post 46 is passed through the slots 54 in the cam followers. The plates are then affixed to the posts in spaced apart locations by being moved laterally so as to cause the plates at the narrower portions 64 of the through openings where formed with circular cut-outs 68 to be elastically snapped into undercuts 78 (reduced cross-sectional portions) in the posts. The plates are formed with V-shaped slots 72 alongside of the plate openings in which posts 42 and 44 are received. Such V-shaped slots facilitate temporary enlargement of the narrower portions 64 of the openings 60 as the plates are moved laterally to elastically embrace the undercuts in the posts.

In the described construction, each of plates 32, 34, 36, 38 and 40 supports a fraction of the total number of push-button extensions and a fraction of the total number of cam followers. The accumulation of weight in the various sets of push-button extensions and cam followers separated by the snap-on plates is therefor limited, and a build-up of large frictional forces between the slidable plates and slidable cam followers is prevented. The separation of the push-button extensions and cam followers into sets by the snap-on plates also prevents a deleterious build-up of manufacturing tolerance variations in the push-button extensions and/or the cam followers such as could otherwise prevent proper cooperation between the extensions and cam followers.

It is to be understood that the present disclosure relates to a preferred embodiment of the invention which is for purposes of illustration only, and is not to be construed as a limitation of the invention. Numerous alterations and modifications by the structure herein disclosed will suggest themselves to those skilled in the art, and all such modifications which do not depart from the spirit and scope of the invention are intended to be included within the scope of the appended claims.

We claim

1. In a control module for a sewing machine, multiple rows of push-buttons each of which includes a rearward extension, a plurality of spaced apart plates which separate the push-button extensions into sets, and a plurality of posts upon which the plates are affixed, the push-button extensions in each of the said sets being contiguously stacked for relative sliding movement, and each set being supported on a separating plate.

2. The combination of claim 1 wherein the push-button extensions include elongate slots, and the posts extend through said slots to guide movement of the push-buttons.

3. The combination of claim 1 wherein the plates are of a resilient material and are formed to elastically embrace and hold the plates in fixed positions on the posts.

4. The combination of claim 3 wherein the plates are of a plastic material.

5. The combination of claim 3 wherein the posts include reduced cross-sectional portions and the plates elastically grip the posts in the reduced cross-sectional portions.

6. The combination of claim 1 wherein the plates are of a resilient material and include openings with enlarged end portions through which the plates can be threaded onto the posts, said openings also including narrowed portions in which the plates can grip the posts and into which the posts can be snapped by lateral movement of the plates.

7. The combination of claim 6 wherein the posts include reduced cross-sectional portions engageable by the plates in the narrowed portions of the plate openings.

8. The combination of claim 1 including cam followers in alignment with the push-button extensions for actuation thereby, the cam followers being contiguously stacked for slidable movement and being supported on the plates which support the push-button extensions.

9. The combination of claim 8 wherein each of the cam followers includes an elongate slot and a post extends through said slots to guide movement of such parts.

* * * * *